United States Patent [19]

Marcade et al.

[11] 4,018,147

[45] Apr. 19, 1977

[54] REFUSE COMPACTOR WITH AUTOMATIC DRAWER OPENER

[75] Inventors: Roque Denis Marcade, Stevensville; Vincent Paulraj Gurubatham, St. Joseph, both of Mich.

[73] Assignee: Whirlpool Corporation, Benton Harbor, Mich.

[22] Filed: July 22, 1975

[21] Appl. No.: 598,050

[52] U.S. Cl. ..... 100/45; 100/53; 100/218; 100/229 A

[51] Int. Cl.[2] ..... B30B 15/14

[58] Field of Search ..... 100/45, 53, 215, 229 A, 100/229 R, 221, 224, 218

[56] References Cited

UNITED STATES PATENTS

| | | | |
|---|---|---|---|
| 1,040,396 | 10/1912 | Paal | 100/218 |
| 1,053,590 | 2/1913 | Gilchrist | 100/229 R |
| 1,675,669 | 7/1928 | Snyder | 100/218 |
| 1,822,923 | 9/1931 | Duerr | 100/229 R |
| 2,812,543 | 11/1957 | Stacy | 100/229 R |
| 3,357,346 | 12/1967 | Crafoord | 100/229 A |

*Primary Examiner*—Billy J. Wilhite
*Attorney, Agent, or Firm*—Wegner, Stellman, McCord, Wiles & Wood

[57] ABSTRACT

A refuse compactor arranged for automatically moving the drawer from a compacting position toward an exposed refuse-receiving position. The movement is effected herein by modified operation of the compacting ram structure. More specifically, the automatic movement of the drawer is effected by the operation of the power drive provided for operating the ram normally between compacting and retracted positions.

11 Claims, 4 Drawing Figures

COMPACT
OPEN
L1
L2
TO 155
LOW LIMIT (OPEN) SWITCH 57
COMPACT. DRAWER SAFETY SWITCH 29
RUN SWITCH 31
START SWITCH 25
DRAWER TILT SWITCH 51
TOP LIMIT SWITCH FOR "OPEN" 52
TOP LIMIT SWITCH FOR "COMPACT" 53
CENTRI-FUGAL SWITCH 50
DIRECTIONAL SWITCH
"COMPACT" OR "OPEN" SWITCH
START
RUN
DRIVE MOTOR
MOTOR PROTECTOR

REFUSE COMPACTOR WITH AUTOMATIC DRAWER OPENER

BACKGROUND OF THE INVENTION

1. Field of the Invention

This invention relates to refuse compactors and in particular to means for moving the refuse-receiving receptacle automatically from a compacting position toward a refuse-receiving position.

2. Description of the Prior Art

In one well known form of refuse compactor, a refuse receptacle comprising a drawer is mounted on suitable rollers for selective positioning in a compacting position within an outer cabinet and in a refuse-receiving position outwardly of the cabinet. Rufuse is placed in the drawer with the drawer of the exposed outer position, and upon movement of the drawer into the compacting position in the cabinet, suitable operation of a ram is effected to compress, or compact, the refuse in the drawer so as to permit temporary storage of a substantial amount of refuse in compacted condition, thereby minimizing the refuse-handling effort as in a conventional household.

As a substantial amount of refuse may be so compacted before disposal of the compacted material is necessary, a substantial weight of refuse may be accumulated in the receptacle. Further, in the normal use of such refuse compactors, the user may have both hands occupied with the refuse, making it difficult to effect the movement of the drawer from the compacting position to the refuse-receiving position.

One type of attempted solution to this problem is illustrated in U.S. Letters Pat. Nos. 3,726,211 of Floyd R. Gladwin and 3,754,503 of Ransom J. Hennells. In these patents, foot pedal devices are provided permitting the user to effect a selective movement of the refuse container by foot operation of the pedal mechanisms.

In U.S. Letters Pat. No. 2,699,368 of Alois Selmer, a garbage disposal unit is disclosed wherein a carriage is automatically moved through a rectangular opening of a kitchen cabinet by spring tension means under the control of a foot lever. The foot lever is further arranged to lift a cover member from the container prior to the release of the carriage and maintains the cover member in the elevated position until the container is reseated in the cabinet.

Another group of prior art patents discloses different forms of pedal mechanisms in connection with garbage disposal units. Included are U.S. Letters Pat. Nos. 2,813,771 of Alois Selmer, 2,934,390 of Walter P. Wright and 3,183,050 of Archie C. Hudson.

SUMMARY OF THE INVENTION

The present invention comprehends an improved means for automatically initiating open movement of the refuse compactor receptacle. More specifically, the invention comprehends the use of means for operating the compacting ram in a modified manner to effect the desired receptacle movement. In the illustrated embodiment, the invention comprehends the movement of a drawer-type receptacle from the compacting position toward the refuse-receiving position by means associated with the ram including means for effecting a modified movement of the ram means to effect the desired drawer opening operation.

The invention comprehends a controlled operation of the drawer opening means as by manipulation of a control button for effecting the desired modified operation of the ram means. The control means may include selector means for permitting selectively the operation of the ram means in a compacting operation or in a drawer opening operation, as desired.

The drawer opening means may be correlated with the control circuitry of the ram operating means for facilitated manufacture and minimization of maintenance requirements.

The drawer opening means may comprise mechanism adapted to be operated by the ram means for effecting the desired drawer-opening movement as a function of the modified operation of the ram means. More specifically, the ram means may be caused to move to a drawer opening position beyond the normal retracted position by operation of the drawer-opening control.

Thus, the present invention comprehends an improved refuse compactor structure permitting facilitated utilization of the compactor by an automatic drawer opening operation effected in a novel and simple manner.

BRIEF DESCRIPTION OF THE DRAWING

Other features and advantages of the invention will be apparent from the following description taken in connection with the accompanying drawing, wherein.

DESCRIPTION OF THE PREFERRED EMBODIMENT

Figures 1, 2, 3, 4:
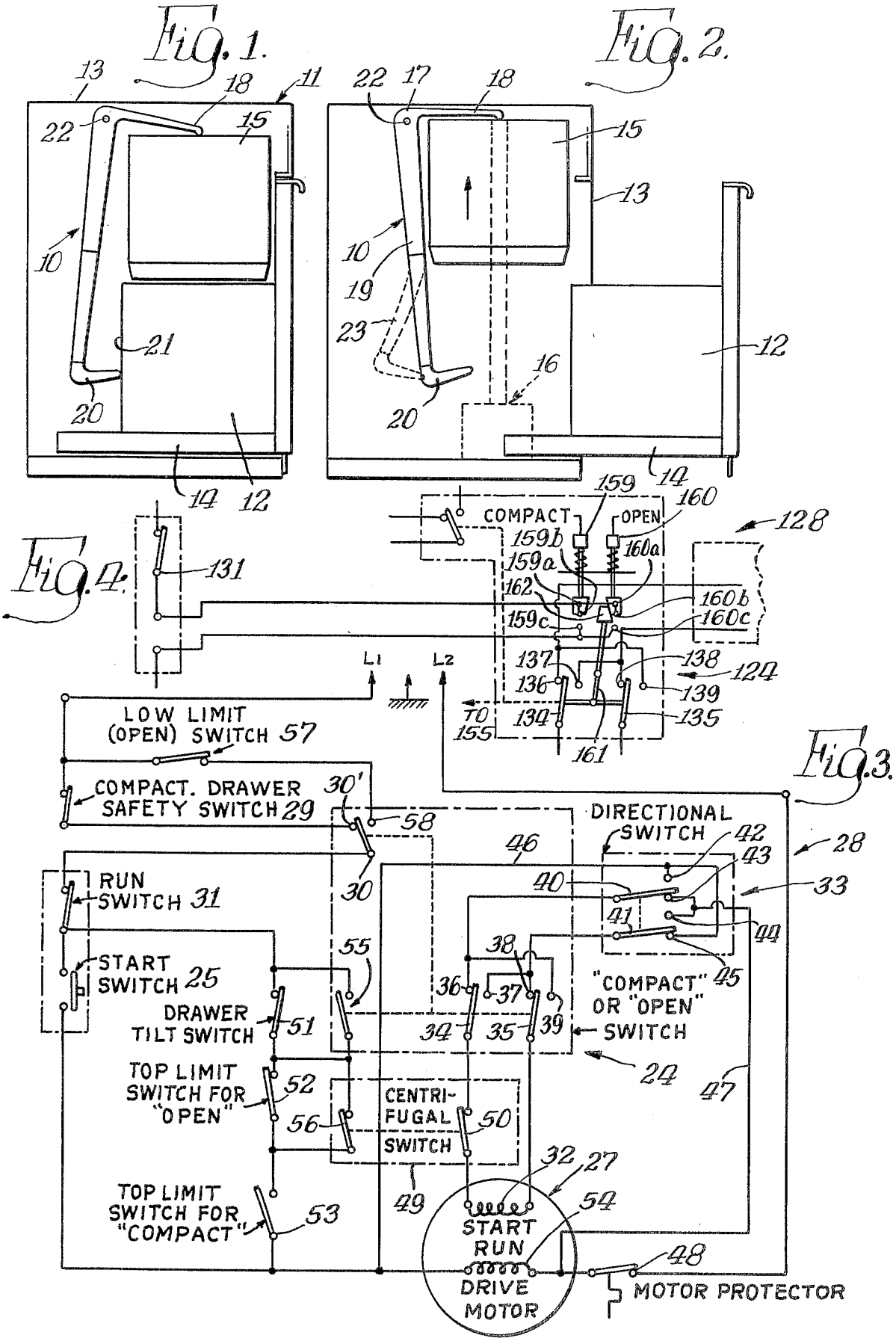
FIG. 1 is a schematic side elevation of a refuse compactor having a drawer opening mechanism embodying the invention, the drawer being shown in an inner compacting position.
FIG. 2 is a schematic elevation similar to that of FIG. 1 with the drawer being illustrated in an outer refuse-receiving position.
FIG. 3 is a schematic electrical wiring diagram of the control for effecting the automatic movement of the drawer.
FIG. 4 is a schematic representation of a modified form of control switch means for use in the control of FIG. 3.

In the exemplary embodiment of the invention as shown in FIGS. 1–3 of the drawing, apparatus generally designated 10 is provided in a refuse compactor generally designated 11 for causing the refuse receptacle 12 of the compactor to move from a compacting position within a cabinet 13 toward an exposed refuse-receiving position outwardly of the cabinet. In the illustrated embodiment, the receptacle 12 comprises a drawer carried on suitable roller track means 14 for facilitated movement between the compacting and refuse-receiving positions. The roller track 14 may be positioned in the cabinet horizontally or, alternately, may be suitably slanted toward the front of the cabinet 13 over a portion of their extent to assist in the opening of the drawer once started by the mechanism 11.

The compactor includes a compacting ram 15 which is selectively operated by a suitable drive generally designated 16 to move downwardly into drawer 12 in the compacting position to compact refuse therein and, upon completion of the compacting operation, move to an upper retracted position superjacent to the drawer, as shown in FIG. 1. Drive 16 includes an electric motor 27 which is controlled by a suitable electrical control 28, as shown in FIG. 3, to effect the desired bidirectional movement of the ram.

The present invention comprehends utilization of the drive 16 to further effect the desired movement of the drawer 12 from the compacting position of FIG. 1 toward the refuse-receiving position of FIG. 2. As illustrated in FIG. 2, ram 15 herein may be moved upwardly beyond the retracted position (of FIG. 1) to a drawer-opening position whereby the ram operates apparatus 10 to effect the desired drawer movement.

As will be obvious to those skilled in the art, any suitable mechanism or device may be employed for translating the modified movement of the ram into a drawer movement force under the control of the user. In the illustrated embodiment, apparatus 10 comprehends a crank 17 having a first arm 18 engaged by the ram 15 in the upper drawer-opening disposition and a lower arm 19 extending downwardly to a foot 20 engaging the rear portion 21 of drawer 12. The crank is carried on a pivot 22 such that upward movement of arm 18 causes a forward movement of foot 20, as illustrated in FIG. 2, to urge the drawer forwardly to the refuse-receiving position. As further illustrated in FIG. 2, the lower portion 23 of arm 19 may be resilient, such as by being formed of a suitable resilient material, to provide a yielding engagement of apparatus 10 with the drawer so as to prevent damage to the mechanism in the event the drawer is stuck and to provide an improved facilitated movement of the drawer in normal operation of apparatus 10.

The arm 19 as shown is preferably of greater length than arm 18 so as to provide a relatively large movement of foot 20 at a given small upward movement of ram 15 for facilitated opening of the drawer. Arm 18 preferably engages the ram 15 at the fore and aft central vertical plane thereof so as to avoid cocking the ram laterally and thereby avoiding control switch tolerance problems.

As indicated briefly above, operation of apparatus 10 to effect automatic drawer opening may be effected by the user manipulating a suitable control switch such as switch 24 illustrated in FIG. 3. Switch 24, as shown therein, may comprise a 4-pole, double-throw switch which is shown in FIG. 3 in a first position which, in control 28, comprises the Compact position. With switch 24 in the Compact position, control 28 effects an automatic operation of the ram to effect the desired compacting of refuse in drawer 12 by the user's depression of a Start switch 25. With the switch 24 thrown to the "Open position," manipulation of Start switch 25 effects the modified movement of ram 15 to effect the operation of apparatus 10 for moving the drawer 12 outwardly to the refuse-receiving position as discussed above.

Power for operating the drive 16 is provided from power supply leads L1 and L2, as shown in FIG. 3. Power is provided from lead L1 through drawer safety switch 29 and contacts 30, 30′ of switch 24 to a power supply run switch 31 which is closed when it is desired to effect operation of the compactor. Normal compacting operation is effected by the user depressing Start switch 25, as indicated above, so as to continue the circuit from switch 31 through to drive motor 27 which in turn is connected to power supply lead L2.

To effect the operation of drive motor 27 in the desired direction, the start winding 32 is connected through a directional switch generally designated 33 to Start switch 25 and through directional switch 33 to power supply lead L2. Directional switch 33 is actuated suitably by the ram 15 so that when the ram is in the retracted position of FIG. 1, switch 33 connects the start winding 32 suitably to start motor 27 and effect a downward movement of the ram by motor 27, and when the switch is thrown to its opposite position as a result of the ram moving a preselected distance from the retracted position, the directional switch is conditioned to cause a reverse operation of the drive motor to restore the ram to the retracted position of FIG. 1 when the centrifugal switch contacts 50 reclose as a result of the motor stalling due to the ram reaching a predetermined compacting pressure. Switch 24 effectively defines means for reversing the logic of switch 33. More specifically, switch 24 further includes a first moving contact 34, a second moving contact 35, first fixed contact 36, second fixed contact 37, third fixed contact 38 and fourth fixed contact 39. Fixed contacts 36 and 39 are connected to a first moving contact 40 of switch 33 and fixed contacts 37 and 38 are connected to a second moving contact 41 of switch 33. Switch 33 includes a first fixed contact 42, a second fixed contact 43, a third fixed contact 44 and a fourth fixed contact 45. A lead 46 from Start switch 25 is connected to fixed contacts 42 and 45. A lead 47 from fixed contacts 43 and 44 is connected through a conventional motor protector overload device 48 to power supply lead L2.

The control 28 includes a conventional centrifugal switch 49 having a first normally closed switch 50 connected from moving contact 34 to one end of the start winding 32, the other end of the start winding being connected to move contact 35 of switch 24 and a second normally closed switch 56.

A drawer tilt switch 51 is connected in series with a normally closed top limit switch 52 and a normally open top limit switch 53 from run switch 31 to one side of the drive motor run winding 54, the other side of the run winding being connected through motor protector 48 through power supply lead L2. Switch 55 of switch 24 is connected in parallel with drawer tilt switch 51, and a normally closed switch 56 of centrifugal switch 49 is connected in parallel with top limit switch 52.

A normally closed low limit switch 57 is connected from power supply lead L1 to a fixed contact 58 associated with movable contact 30 of switch 24.

The switch 24 is shown in FIG. 3 in the Compact position. To effect a compacting cycle, the user may press Start switch 25 so as to complete a circuit from power supply lead L1 through switches 29, 30 – 30′ and 31 to run winding 54 and to lead 46 and effect energization of start winding 32 with directional switch 33 as shown to effect a downward movement of the ram from the retracted position of FIG. 1 for compacting refuse in drawer 12. The downward movement of the ram operates the directional switch 33 as described above to condition it for retracting the ram and also closes top limit switch 53 to provide a circuit around start switch 25. As indicated above, the drive motor 27 is automatically reversed when it stalls upon compaction of the refuse as a result of centrifugal switch 50 reclosing with the direction switch 33 having been conditioned to engage moving contacts 40 and 41 with fixed contacts 42 and 44, respectively, thereby to connect the start winding to effect upward movement to restore the ram to the retracted position of FIG. 1. In returning the ram to the retracted position, top limit switch 53 terminates the upward movement by breaking the circuit from run switch 31 to the drive motor.

When it is desired to effect an automatic drawer-opening cycle, the user may reposition switch 24 to the "open position," thereby reversing the connections from the directional switch 33 to the start winding 32. Operation of Start switch 25 now effects an opposite movement of the drive motor so as to cause firstly an upward movement of the ram to effect the desired drawer opening in moving to an uppermost position as shown in FIG. 2. The initial upward movement recloses switch 53 so that the upward movement is now controlled by the top limit switch 52 which opens when the ram reaches the position of FIG. 2. Upon stopping of the drive motor 27, centrifugal switch contacts 56 reclose, so as to provide power around open switch 52. When the ram commenced upward movement from the retracted position of FIG. 1, directional switch 33 was operated to be conditioned for downward movement so that application of power now through closed switch 56 causes a reverse operation of motor 27 to drive the ram downwardly thereby reclosing switch 52 allowing the motor to driven the ram back to the retracted position of FIG. 1. The downward movement continues until top limit switch 53 is again opened at the retracted position of the ram to restore the ram to the arrangement of FIG. 1.

Low limit switch 57 controls the delivery of current through movable switch portion 30 and contact 58 of switch 24. When switch 24 is thrown to the open position, switch portion 30 is closed with fixed contact 58 so that low limit switch 57 controls the delivery of power to the drive motor. Switch 57 is caused to be open in the event the ram is below the retracted position of FIG. 1 when the switch 24 is thrown to the Open position, thus assuring that the ram will now be driven to the bottomed out compacting position with switch 24 in the Open position inasmuch as the reversed logic of directional switch 33 is not preconditioned to drive the ram upward but rather downward which could cause damage to the motor or drive train should the motor stall at the bottom with the start winding connected for downward movement.

Switch portion 55 of switch 24 bypasses drawer tilt switch 51 when the compactor is being operated in the drawer-opening mode to permit the opening operation notwithstanding a prior tilting of the drawer so that readjustment of the refuse in the drawer may be readily effected.

Referring now to FIG. 4, a modified control generally designated 128 is shown to utilize a modified Compact-Open switch generally designated 124.

Switch 124 includes moving contacts 134 and 135 and fixed contacts 136, 137, 138 and 139 corresponding to contacts 34–39 of switch 24. However, the operation of the refuse compactor by the user is effected by suitable manipulation of a Compact push button 159 and an Open push button 160. Moving contacts 134 and 135 are connected to a toggle 161 which is operated selectively to engage moving contact 134 with fixed contacts 136 or 137 and moving contact 135 with fixed contacts 138 or 139 as a function of the manipulation of the push buttons 159 or 160.

Thus, toggle 161 includes an operator portion 162 which is engaged by actuating portions **159*a* and 160*a* of push buttons 159 and 160, respectively, to effect the toggle selective positioning of the moving contacts 134 and 135.**

Operator **159*a* of push button 159 carries a moving contact 159*b* and operator 160*a* of push button 160 carries a moving contact 160*b*, which moving contacts are selectively engageable with fixed contacts 159*c* and 160*c*, respectively. The contacts 159*b* and 159*c* and contacts 160*b* and 160*c* define a momentary switch connected in series with the run switch 131 in lieu of the Start switch 25 of control 28. Thus, start operation may be effected by the depression of either the Compact push button 159 or the Open push button 160. However, as discussed relative to control 28, depending on the position of the moving contacts 134 and 135,** the logic of the control selectively is reversed so that the ram will be selectively lowered in a compacting operation or raised in a drawer opening position, depending on which push button is depressed with the ram in the retracted position.

When the user depresses the Compact button, the toggle 161 is operated to the position shown in FIG. 4, and a compacting operation is initiated by the closing of contact **159*b* with fixed contact 159*c* to provide a start circuit similar to the start circuit effected by the depression of Start switch 25 in control 28. The selector switch 124 is shown in FIG. 4** as in the compact position whereby a compacting operation is effected in the normal manner.

When the user wishes to open the drawer by means of the push button 160, manual depression of that push button throws the toggle 161 to the left as seen in FIG. 4, thereby reversing the selector switch 124 to place the control in the "Open" mode and then closes contact **160*b* with fixed contact 160*c*. Resultingly, the drive motor 27 is operated in a reverse direction to effect the "Open" operation discussed relative to control 28. As shown in FIG. 4, the push buttons are biased to cause the moving contacts 159*b* and 160*b* to be spaced from fixed contacts 159*c* and 160*c* in the normal arrangement of the Compact-Open switch 124. The control 128 functions in the same manner as control 28 in controlling the operation of the ram in all other respects, and elements of control 128 which are similar to elements of control 28 are identified by similar reference numerals, but 100** higher.

Having described my invention as related to the embodiments shown in the accompanying drawings. It is my intention that the invention be not limited by any of the details of description, unless otherwise specified, but rather, be construed broadly within its spirit and scope as set out in the appended claims.

Having described the invention, the embodiments of the invention in which an exclusive property or privilege is claimed are defined as follows:

1. In a refuse compactor having a receptacle for receiving refuse to be compacted, means for movably mounting the receptacle for selective manual positioning in a compacting position and an exposed refuse-receiving position, a ram, and powered means for selectively moving the ram in a compacting cycle from a retracted position into said receptacle in said compacting position for compacting refuse in the receptacle, said powered means returning the ram to the retracted position with the receptacle retained in the compacting position upon completion of the compacting cycle, the improvement comprising means for selectively causing an operation of said powered means in an opening cycle to cause said receptacle to move from said compacting position toward said exposed position.

2. The refuse compactor structure of claim 1 wherein said means for causing said receptacle to move comprises means responsive to movement of said ram by said powered means to a receptacle-opening disposition.

3. The refuse compactor structure of claim 1 wherein said means for causing said receptacle to move comprises means for causing said ram selectively to have movement different in said opening cycle from the refuse-compacting movement in said compacting cycle and means responsive to said different movement of the ram to cause said receptacle to move.

4. The refuse compactor structure of claim 1 wherein said means for causing said receptacle to move comprises means for causing said ram selectively to move away from said receptacle in said opening cycle to an extreme outer disposition, and means responsive to said movement of the means away from the receptacle to said extreme outer disposition to cause said receptacle to move.

5. The refuse compactor structure of claim 1 wherein said means for causing said receptacle to move comprises yieldable means permitting full movement of the powered means notwithstanding a stuck condition of the receptacle in the compacting position.

6. The refuse compactor structure of claim 1 wherein said powered means includes electrical drive means and said means for causing said receptacle to move comprises electrical control means selectively operable to cause said drive means to operate in an opening cycle differing from the compacting cycle.

7. In a refuse compactor having a receptacle for receiving refuse to be compacted, means for movably mounting the receptacle for selective positioning in a compacting position and an exposed refuse-receiving position, and powered means including a ram selectively movable in a compacting cycle into said receptacle in said compacting position for compacting refuse in the receptacle, the improvement comprising means for causing said receptacle to move from said compacting position toward said exposed position as an incident of operation of said powered means in an opening cycle, including manually operable selector means for causing said powered means selectively to cause a compacting cycle or a receptacle opening cycle.

8. The refuse compactor structure of claim 7 wherein said powered means comprises electrical drive means and said selector means comprises manually operable switch means.

9. The refuse compactor structure of claim 7 wherein said powered means comprises electrical drive means including switch means for initiating operation of the drive means, and said selector means comprises manually operable switch means electrically associated with said drive means, and switch means for causing the operation of the drive means initiated thereby to be selectively either of said cycles.

10. The refuse compactor structure of claim 7 wherein said powered means comprises electrical drive means including switch means for initiating operation of the drive means, and said selector means comprises manually operable switch means electrically associated with said drive means and switch means for causing the operation of the drive means initiated thereby to be selectively either of said cycles, said selector switch means being operable independently of said operation initiating switch means to permit selecting the mode of operation prior to effecting the same by subsequent operation of said operation initiation switch means.

11. The refuse compactor structure of claim 7 wherein said powered means comprises electrical drive means including switch means for initiating operation of the drive means, and said selector means comprises manually operable switch means electrically associated with said drive means and switch means for causing the operation of the drive means initiated thereby to be selectively either of said operation cycles, said selector switch means being arranged to effect operation of said operation initiation switch means following operation of said selector switch means.

* * * * *